United States Patent [19]

Bonacorsi

[11] Patent Number: 4,638,730

[45] Date of Patent: Jan. 27, 1987

[54] TRASH COMPACTOR

[75] Inventor: Robert W. Bonacorsi, North Canton, Ohio

[73] Assignee: Phillips Home Products, Akron, Ohio

[21] Appl. No.: 784,317

[22] Filed: Oct. 4, 1985

[51] Int. Cl.[4] ..... B30B 15/06

[52] U.S. Cl. ..... 100/229 A; 53/527; 100/255; 248/101

[58] Field of Search ..... 100/229 A, 255, 229 R; 53/527; 248/99, 101

[56] References Cited

U.S. PATENT DOCUMENTS

| | | | |
|---|---|---|---|
| 3,353,478 | 11/1967 | Hopkins | 100/229 A X |
| 3,537,390 | 11/1970 | Hinkel | 100/229 A X |
| 3,613,566 | 10/1971 | Shapleigh | 100/229 A X |
| 3,765,148 | 10/1973 | Ippolito | 100/229 A X |
| 3,850,094 | 11/1974 | Shontz | 100/255 X |
| 3,862,595 | 1/1975 | Longo | 100/229 A X |
| 3,882,771 | 5/1975 | Frohbieter | 100/229 A X |
| 3,885,467 | 5/1975 | Merkin | 100/229 A |
| 4,128,055 | 12/1978 | Hellmann | 100/255 X |
| 4,275,651 | 6/1981 | Groth | 100/229 A |

FOREIGN PATENT DOCUMENTS

| | | | |
|---|---|---|---|
| 2354781 | 5/1975 | Fed. Rep. of Germany | 100/229 A |
| 2383010 | 11/1978 | France | 100/229 A |

*Primary Examiner*—Billy J. Wilhite

*Attorney, Agent, or Firm*—Pearne, Gordon, McCoy & Granger

[57] ABSTRACT

A trash compactor is disclosed which has a wheeled bin within a trash compactor cabinet. The bin is adapted to contain a trash bag and the trash compacted therein and then may be withdrawn partially from the cabinet so that a handle may be inserted downwardly into vertical apertures in the front of the bin. A fixed pin and latches provide a reaction means to secure the handle in a downward position in the bin front, and this also secures the front wheels of the bin in a downward position of a lost motion between the front wheels and the bin. The wheeled bin may then be completely removed from the cabinet and wheeled to the disposal site. The container front may be unlatched and hinged forwardly and downwardly so that the trash bag may be pulled horizontally out of the wheeled bin for ready removal. In the return of the bin into the cabinet, the lost motion on the wheels permits the wheels to be moved upwardly so that the compaction forces are taken between the bin bottom and the cabinet base plate rather than on the wheels. The foregoing abstract is merely a resume of one general application, is not a complete discussion of all principles of operation or applications, and is not to be construed as a limitation on the scope of the claimed subject matter.

18 Claims, 7 Drawing Figures

TRASH COMPACTOR

BACKGROUND OF THE INVENTION

Previous trash compactors have, to some extent, addressed the problem of transporting the compact trash to the disposal site, e.g., the moving of the compacted trash to a site adjacent the home owner's curb for pickup. To ease the transportation of the trash, wheeled containers have been suggested, for example, as shown in U.S. Pats. Nos. 3,850,094 and 4,275,651. Further, it has been recognized that once the trash is compacted, it is often difficult to remove from the container, even when the trash is compacted within a bag. The very act of compaction tends to spread the compacted mass laterally so that there is high friction with the sides of the bin or container, and therefore it is difficult to withdraw the bag of compacted trash from this container. This is especially difficult if the bag must be withdrawn vertically because the person must not only lift the weight of the trash but also overcome the frictional force between the bag and the container. Some means of expanding the sides of the container has accordingly previously been suggested. In U.S. Pat. No. 3,850,094, about half of the cylindrical container is hinged to swing in a horizontal arc to help release the bag. In U.S. Pat. No. 4,275,651, two restraining L-shaped sides may be swung in horizontal arcs to release the relatively stiff plastic trash container. In U.S. Pat. No. 3,353,478, the trash container may be circumferentially expanded, but still the trash container bag must be lifted out of this container. In U.S. Pat. No. 3,613,566, a side of the container may be tilted to a detent position at about a 45-degree angle to the horizontal, so that the bag need not be lifted directly vertically. U.S. Pat. No. 3,862,595 shows a cylindrical container wherein about half may be pivoted away from the other half to open the container for better removal of the compacted trash. In U.S. Pat. No. 3,882,771, a sleeve is moved into place during the compaction of the trash and then withdrawn from the inside of the bag to give extra space so that the bag may be removed from the container. However, the bag must still be removed vertically.

Since the trash compacting mechanism usually includes a ram which moves vertically downwardly into the bin or container, the compacting force is taken by the bottom of this bin. The bin must rest on some form of bin support or drawer support, which is positioned relative to the entire trash compactor cabinet. Wheels are provided on the bin for easier transportation, but these wheels then present a problem in absorbing the compaction force. U.S. Pat. No. 3,537,390 provides a drawer supported on extensible guide means with rollers, with the guide means having tapered relieved portions so that the drawer is not supported by the tracks in the compacting position of the drawer.

SUMMARY OF THE INVENTION

The problem to be solved, therefore, is how to construct a trash compactor wherein the trash compactor bin may be readily moved to the site of disposal of the compacted trash and the trash may be more readily removed from the bin.

This problem is solved by a trash compactor comprising, in combination, a cabinet adapted to rest on a floor, a wheeled bin receivable inside the lower portion of the cabinet, a compactor mechanism in the upper portion of said cabinet adapted to compact trash in the bin, first and second wheels, means journaling said first and second wheels, one near each front corner of said bin, generally vertical lost motion means acting between said journal means and said bin permitting the two wheels to be moved upwardly relative to said bin at least when said bin is in said cabinet and acted on by said compactor mechanism, and reaction means acting between said bin and said journal means to establish the wheels in the downward position whereby the wheeled bin may be withdrawn from the cabinet and be supported on the wheels for rolling engagement with the floor.

Accordingly, an object of the invention is to provide wheels on a trash compactor bin to permit ready transportation of the loaded bin.

Another object of the invention is to provide a trash compactor wheeled bin with means to have the bin bottom absorb the trash compaction force without the force being borne by the wheels.

Another object of the invention is to provide a wheeled trash compactor bin with means to lower the front of the bin for generally horizontal removal of the trash instead of lifting the trash.

Other objects and a fuller understanding of the invention may be had by referring to the following description and claims, taken in conjunction with the accompanying drawing.

DESCRIPTION OF THE PREFERRED EMODIMENT

Figure 1:
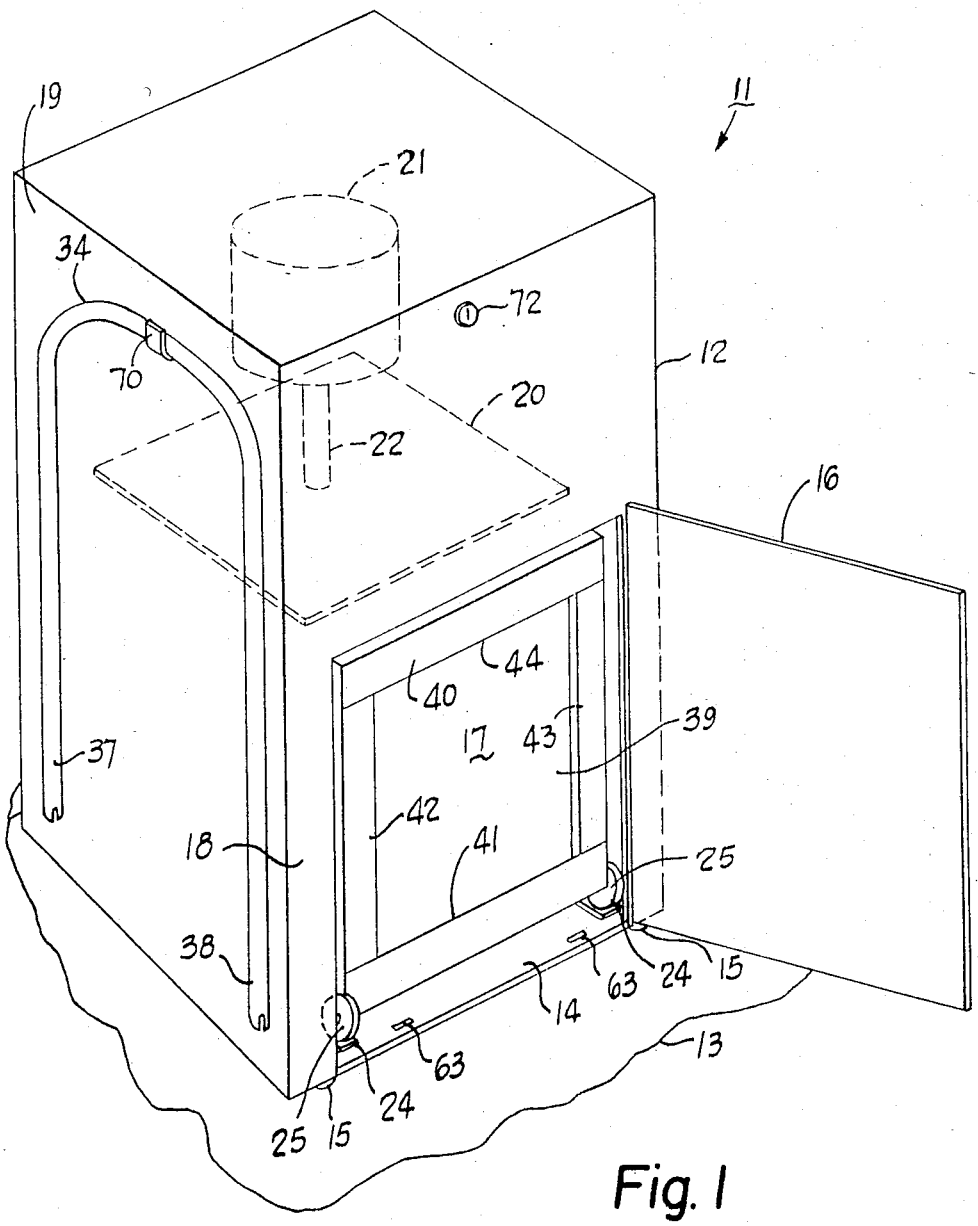
FIG. 1 is an isometric view of a trash compactor embodying the invention.

FIGS. 1–7 illustrate a trash compactor 11 which includes generally a cabinet 12 adapted to rest on the floor of a building. This may be a garage floor as a suggested location for the trash compactor 11. Since garage floors are often not level, e.g., providing a slope to a drain, the cabinet has a base plate 14 which is supported on adjustable mounting feet 15. A hinged door 16 may be swung to one side to provide access to a wheeled bin 17 in a lower portion 18 of the cabinet 12. The upper portion 19 of the cabinet 12 contains a compactor mechanism, such as a downwardly movable ram 20, movable by an electric motor 21 through drive means 22. The motor is adapted to drive the ram 20 vertically downwardly into the wheeled bin 17 to compact trash. The base plate 14 may have depressions 24 to receive and help locate front wheels 25 on the bin 17.

Figure 2:
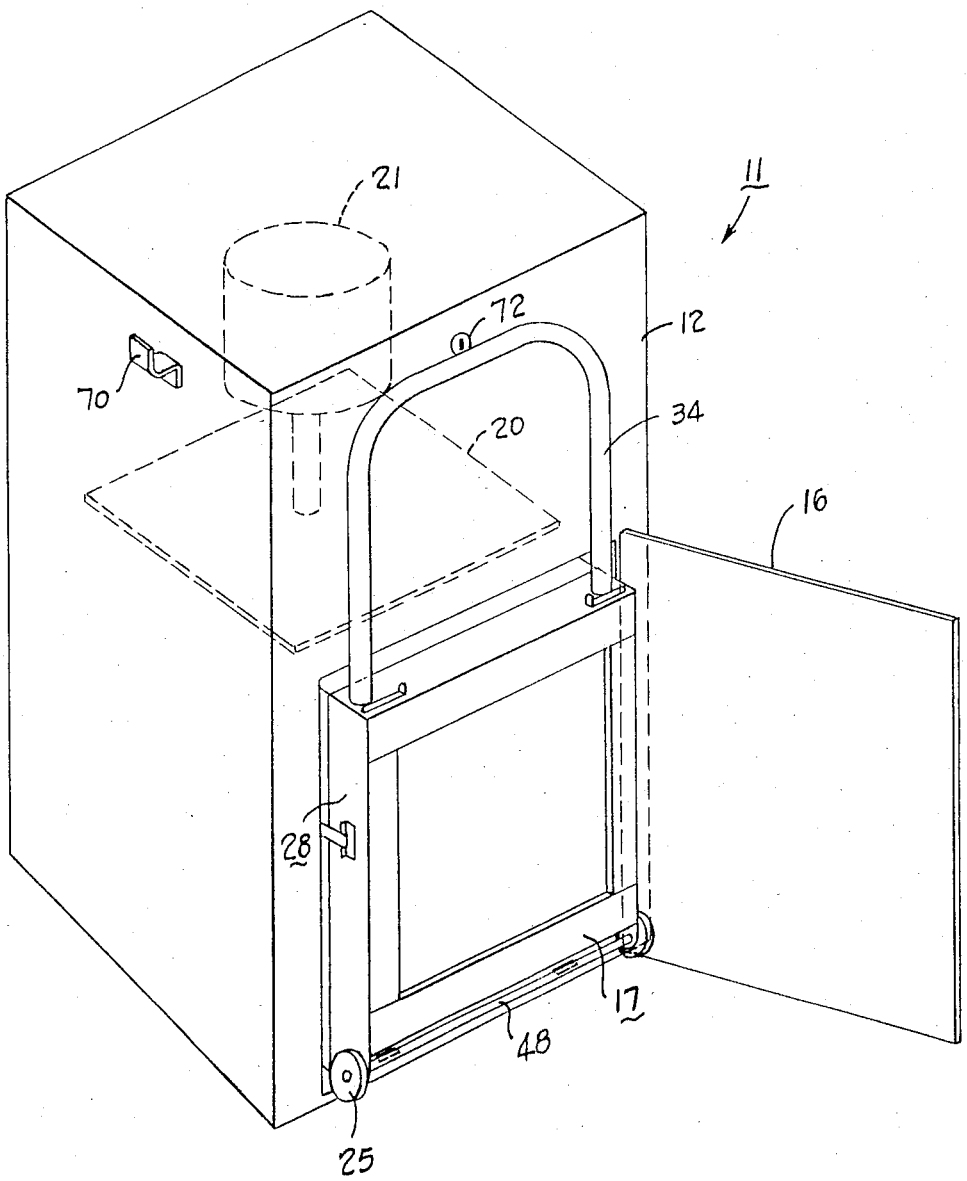
FIG. 2 is an isometric view of the trash compactor with the bin partially removed from the compactor cabinet.
Figure 3:
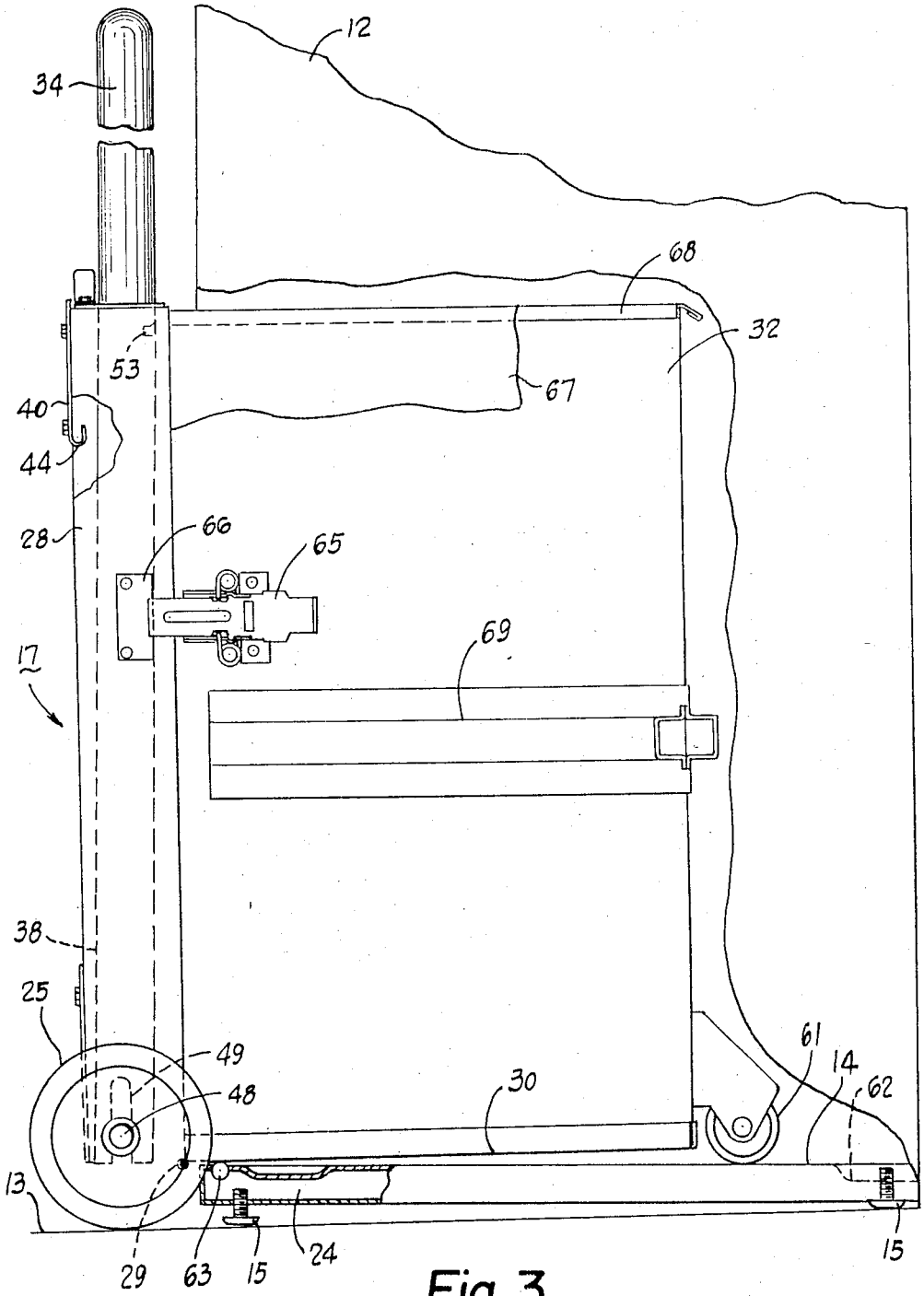
FIG. 3 is a side view of the trash compactor bin partially removed from the cabinet, similar to the bin position of FIG. 2.

FIGS. 2 and 3 show the wheeled bin 17 partially removed from the cabinet 12 and FIGS. 4–7 show details of the construction of this bin 17. The wheeled bin 17 has a generally vertical front 28, hinged at 29 to a bin bottom 30, two vertical sides 31 and 32, and a rear wall 33. All of these may be made from heavy gauge sheet metal and the bin front 28 is relatively thick to receive an elongated handle 34. This handle is received in a vertical aperture, and in the preferred embodiment there are two vertical apertures 35 and 36 near the two bin sides 31 and 32 to receive two portions of the handle 34. This handle is an inverted, U-shaped handle, with the two ends 37 and 38 thereof received in the vertical apertures 35 and 36, respectively. The thickness of the vertical bin front 28 establishes the vertical apertures 35 and 36 and this bin front includes generally a rear wall 39, top and bottom braces 40 and 41, and side braces 42 and 43. These four braces 40–43 establish an opening, so that the rear wall 39 may be seen, as in FIGS. 1 and 2, and so that the bottom edge 44 of the top brace 40 constitutes a handle for grasping and pulling the bin 17 out of the cabinet 12. Each of the braces 40–43 is an angle brace to enclose the sides of the bin front 28, as well as the top and bottom thereof, except for the vertical apertures 35 and 36 extending through the top brace 40.

Journaling means is provided for the first and second front wheels 24, one near each corner of the bin 17. In the preferred embodiment, this journaling means is provided by an axle 48 with a wheel journaled on each end. Generally vertical lost motion means acts between this journal axle and the bin 17, and permits the two wheels to be moved upwardly and downwardly relative to the bin 17. This lost motion means includes an elongated, vertical slot 49 in the side braces 42 and 43. Reaction means 50 acts between the bin 17 and the journal axle 48 to establish the wheels in the downmost position of the lost motion slot 49, and hence the bin may be wheeled along the ground or floor 13. This reaction means 50 includes generally forked ends 51 on the bottom of the handle 34, and also latch means 52. The latch means acts between the handle and the cabinet in this downmost position of the front wheels to establish the downmost position of the handle 34, and hence the downmost position of the axle 48 and wheels 25. The latch means 52 acts in the same manner on both sides of the handle, and includes a fixed pin 53 which extends horizontally and internally of the bin front 28 into each of the vertical apertures 35 and 36. This fixed pin 53 is adapted to be received in a lateral aperture 54 in each handle end 37 and 38. The latch means 52 further includes slidable latches 55 and 56 movably mounted on the top brace 40 of the bin front 28. Each latch 54 has an elongated slot 57 held by a rivet 58 to permit this lateral sliding movement of the respective latch 55 or 56.

Figure 5:
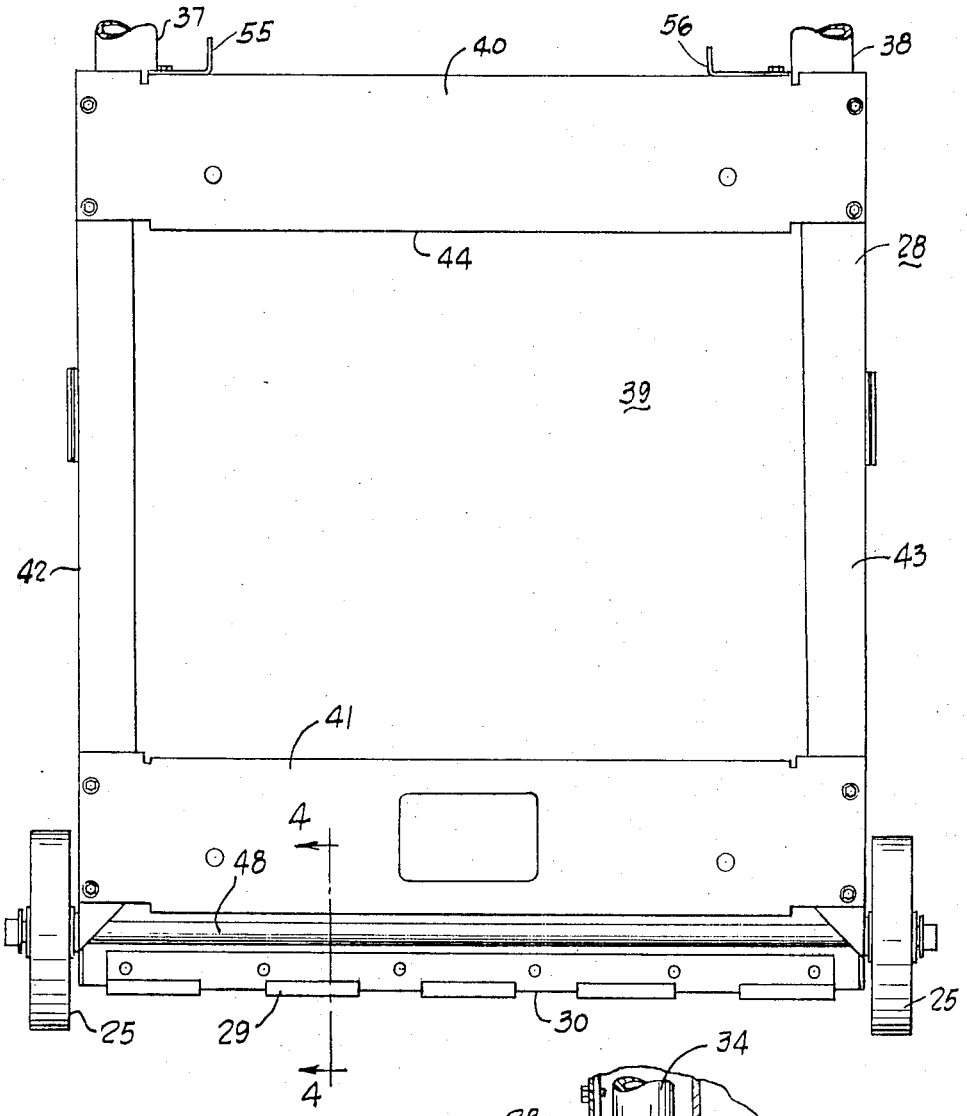
FIG. 5 is a front view of the trash compactor wheeled bin.
Figure 4:
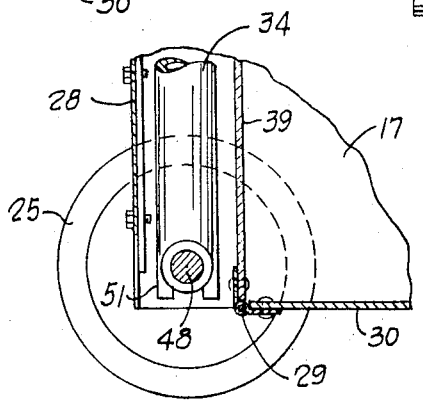
FIG. 4 is a partial side view, partly broken away, to show more structure.
Figure 6:
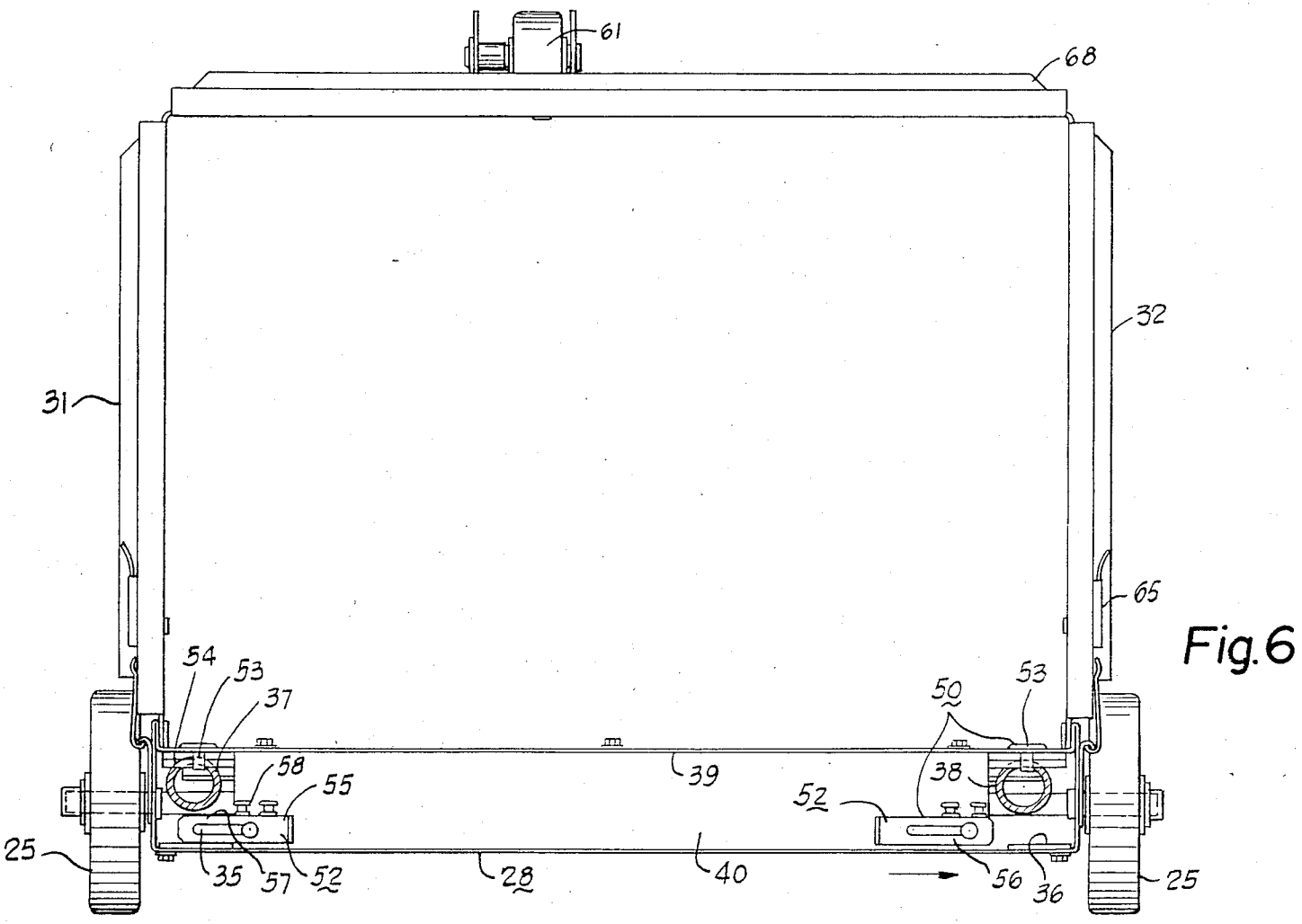
FIG. 6 is a top view of the trash compactor wheeled bin.

In FIGS. 5 and 6, the latch 55 has been shown as moved outwardly to trap the handle 34, and thus to force the handle aperture 54 onto the fixed pin 53. In FIGS. 5 and 6, the latch 56 has not been moved to its outward latched position, and hence that handles end 38 would be free to be moved forwardly so that the fixed pin 53 no longer engaged the lateral aperture 54. The vertical apertures 35 and 36 are sufficiently large, in the front-to-back dimension, to permit the U-shaped handle 34 to be inserted into the vertical apertures 35 and 36 and then moved rearwardly with the lateral aperture 54 on the fixed pin 53, so that the slidable latch 55 or 56 may be moved outwardly to the latched position.

Figure 7:
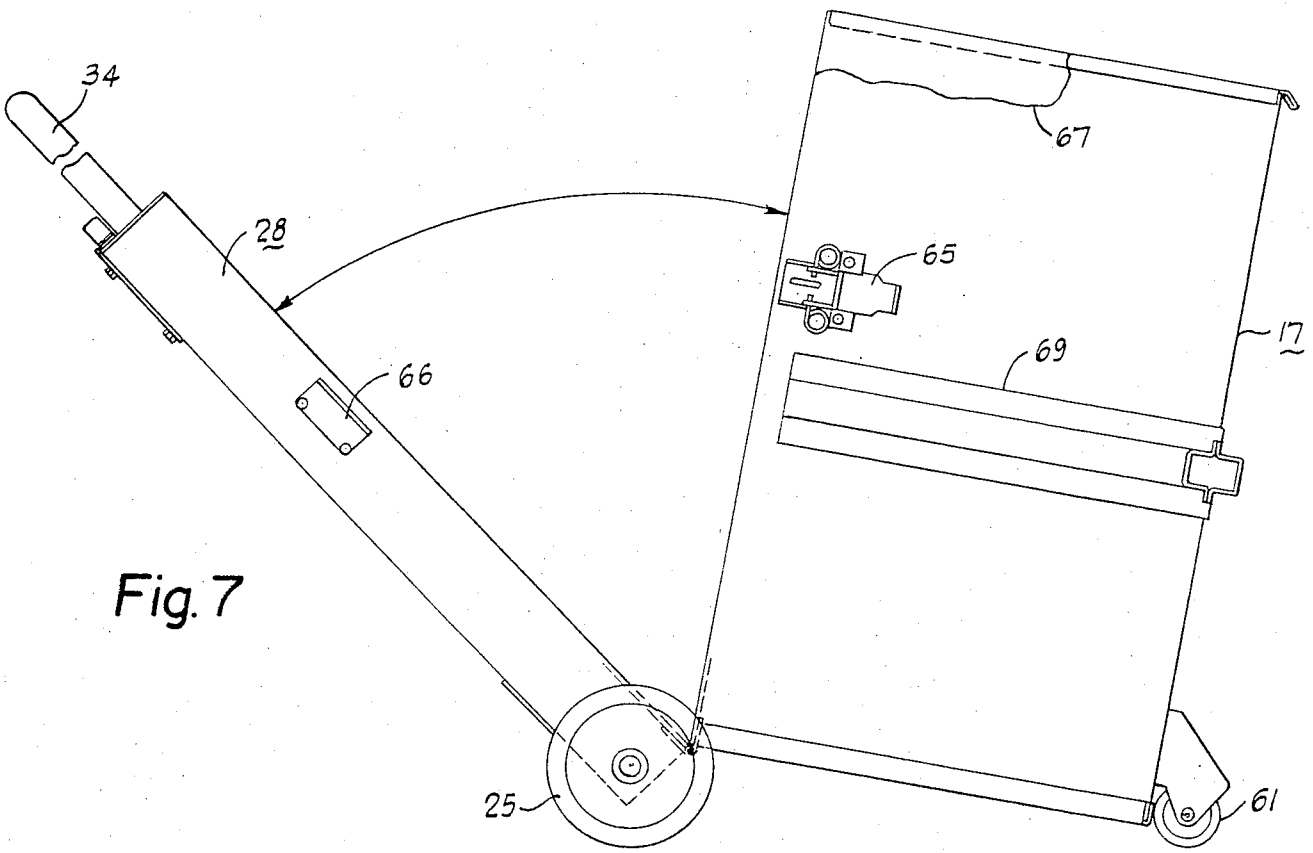
FIG. 7 is a side view of the wheeled bin with the bin front pivoted downwardly.

The wheeled bin 17 preferably includes a third wheel 61 at the rear of the bin, which is on a fixed journal relative to this bin. When the bin is within the cabinet 12, this rear wheel 61 may drop into a depression 62 so that the bin bottom 30 rests on and is supported on the base plate 14 to resist the downward force of the compactor ram. Rollers 63 may be provided on fixed journals at the front of the cabinet base plate 14 so that the bin bottom 30 may roll on these rollers for easier entrance and egress. A toggle latch 65 on each of the two bin sides 31 and 32 is positioned to engage with a latch plate 66 on the bin front 28 to latch this front to the remainder of the bin 17. As shown in FIG. 7, these latches may be unlatched and the bin front 28 swung downwardly to practically a horizontal position on the hinge 29 to permit easier of the compacted trash. This trash will usually be within a trash bag 67, shown partially broken away in FIGS. 3 and 7. The top edge of the trash bag may be folded over the bin sides and rear wall and a reinforcing lip 68 on these bin sides and rear help to mount the trash bag 67, as well as stiffen the sides and rear. Also, this folded-over edge of the trash bag 67 is adapted to be pinched between the bin front 28 and the remainder of the bin 17 when the latches 65 are latched. This securely mounts the trash bag in place so that the downward force of trash compaction does not pull the top edge of the trash bag down into the bin 17. The bin 17 has reinforcing guides 69 on the side and rear, which not only reinforce the side of the bin but may also be used for guiding the entrance and egress of the bin into the cabinet 12. The handle 34 is removable from the bin front 28 and, when not in use on this bin, may be hung on a hook 70 on the side of the cabinet 12.

The trash compactor 11 is adapted for a variety of uses. It may be mounted in a laundry room, utility room, or garage of a residence to receive not only the kitchen refuse but also the yard refuse, such as leaves, grass, and twigs. A key switch 72 is provided for the starting and running control of the electric motor 21 so that the ram may go through a downward reciprocation to compact the trash within the bin 17, and return upwardly to a resting stationary position above the bin 17, shown in FIG. 1. When trash is desired to be placed within the bin, the door 16 may be swung open and the bin handle 44 grasped. A slight upward and outward pull on this handle will lift the wheels out of the base plate depressions 24 and 62, and then the bin may be pulled horizontally outwardly with the wheels 25 and 61 rolling on the base plate as well as the bin bottom rolling on the rollers 63. At this time, the wheels 25 will be near the upper portion of the lost motion slot 49. After the bin has been pulled outwardly from the position of FIG. 1 to the position of FIGS. 2 and 3, then the axle 48 and front wheels 25 will drop downwardly to their downmost position permitted by the lost motion slots 49. The bin bottom 30 will be supported on the rollers 63 and the rear wheel 61 will be rolling on the base plate 14, as shown in FIG. 3. At this time, the handle 34 may be removed from the hook 70 and inserted downwardly into the two vertical apertures 35 and 36 until the forked ends 51 of the handles straddle the axle and rest on this axle. The upper portion of the handle 34 may then be moved rearwardly a slight amount, e.g., one-half inch, until the handle lateral apertures 54 are engaged on the fixed pins 53 in the bin front 28. Then a person may use his two thumbs, for example, to slide the latches 55 and 56 laterally outwardly, and this will secure the handle apertures on the fixed pins 53 and hence secure the handle in its downmost position, with the axle 48 and wheels 25 also secured in their downmost positions. A person may then grasp the upper part of the handle 34 and pull the bin 17 out of the cabinet 12. With the load of compacted trash within the bin 17, the bin may be heavy, for example, 30 or 40 pounds, but the handle may be tilted forwardly about 30 degrees. Rear wheel 61 is raised off the floor 13, with the weight of the compacted trash generally above the front wheels 25. In this position, it is easy to transport the compacted trash in the wheel bin by pulling on the handle to permit the bin to roll on two wheels. This may be a rolling out to the curbside, as an example. The front wheels 25 are sufficiently large to permit rolling over gravel driveways or over a lawn, for example. Once at the disposal site, the bin may be again rested on the wheels and the latches 65 unlatched and the bin front 28 pivoted downwardly to about a horizontal position as shown in FIG. 7. In this condition, the top of the trash bag 67 is no longer pinched between the bin front and the remainder of the bin, so the bag may readily be removed from its foldedover condition on the top of the bin, gathered together, and secured in a usual manner and then the bag simply slid forwardly out of the open front. Because of this hinged front, the heavy bag need not be lifted vertically out of the bin. Also because the bin front has been pivoted downwardly, this releases the compaction force which otherwise might frictionally make it quite difficult to vertically pull the bag out of the closed bin.

After the trash bag has been removed, the bin front may be raised and the latches 65 latched. With the return of the wheeled bin to the cabinet 12, it may be inserted with the rear wheel first into the cabinet and pushed backwardly into the cabinet to about the position shown in FIG. 3. At this point, the latches 55 and 56 may be unlatched, the handle moved forward slightly, and removed upwardly from the bin front 38 and hung on the hook 70. The bin may then be raised slightly by the bin handle 44 and pushed into the cabinet whereat the wheels 25 will move upwardly in the lost motion slot 49 for the axle. The bin will then be in the position shown in FIG. 1, and the door 16 may be closed so that it is ready for another compaction cycle after more uncompacted trash is placed in the bin.

It will be noted that the trash compactor 11 provides a wheeled bin 17 for easy rolling of the bin for disposal of the trash. The bin may be easily moved into and out of the cabinet 12, rolling on the rear wheel 61 and the rollers 63. Since the wheels drop into the base plate depressions 24 and 62, this not only helps locate the bin in proper position for compaction by the rim 20 but also establishes the bin bottom in initmate contact with the base plate 14. The ram may develop a force in the order of three or four thousand pounds, and this force is resisted by the base plate 14, and not by the wheels. At this time of compaction, the front wheels are moved upwardly relative to the bin in the lost motion slots 49 so that this compaction force is not borne by the wheels. The front wheels drop downwardly as the bin is withdrawn from the cabinet, and may be secured in that position by the reaction means 50. In this downward secured position, there is sufficient ground clearance between the bottom of the bin and the floor or ground 13 so that the wheeled bin may readily be moved over a gravel driveway or a lawn.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A trash compactor comprising, in combination:

a cabinet having upper and lower portions and adapted to rest on a floor;

a wheeled bin receivable inside the lower portion of the cabinet;

a compactor mechanism in the upper portion of said cabinet adapted to compact trash in the bin;

first and second wheels;

means journaling said first and second wheels on said bin;

generally vertical lost motion means acting between said journal means and said bin permitting the two wheels to be moved upwardly relative to said bin at least when said bin is in said cabinet and acted on by said compactor mechanism;

a bin support in said cabinet above the floor;

said lost motion means permitting said two wheels to be moved upwardly relative to said bin and establishing said two wheels rollable on said bin support as the bin is pushed into the cabinet, and conversely permitting the wheels to drop downwardly a limited extent as the bin is withdrawn from said cabinet; and reaction means acting between said bin and said journal means to establish the wheels in a downward position whereby the wheeled bin may be withdrawn from the cabinet and be supported on the wheels for rolling engagement with the floor.

2. A trash compactor as set forth in claim 1, wherein said bin is adapted to rest on said bin support.

3. A trash compactor as set forth in claim 1, including a door on said cabinet openable for access to said bin.

4. A trash compactor as set forth in claim 1, wherein said compactor mechanism includes a downwardly movable ram to compact trash downwardly into said bin.

5. A trash compactor as set forth in claim 1, wherein said journaling means including an axle, and said lost motion means permits generally vertical movement of said axle.

6. A trash compactor as set forth in claim 5, including a third wheel near a rear portion of said bin for at least three-wheeled support of said bin.

7. A trash compactor as set forth in claim 1, wherein said bin has a bottom adapted to rest on said bin support at least when the bin is in the cabinet and acted on by said compactor mechanism.

8. A trash compactor comprising, in combination:

a cabinet having upper and lower portions and adapted to rest on a floor;

a wheeled bin receivable inside the lower portion of the cabinet;

a compactor mechanism in the upper portion of said cabinet adapted to compact trash in the bin;

at least one wheel;

means journaling said at least one wheel on said bin;

generally vertical lost motion means acting between said at least one wheel and said bin permitting said at least one wheel to be moved upwardly relative to said bin at least when said bin is in said cabinet and acted on by said compactor mechanism;

reaction means acting between said bin and said at least one wheel to establish said at least one wheel in the downward position whereby the wheeled bin may be withdrawn from the cabinet and be supported on said at least one wheel for rolling engagement with the floor; and said reaction means including latch means acting between said bin and said at least one wheel to lock said at least one wheel in the downward position.

9. A trash compactor as set forth in claim 1, wherein said reaction means includes an elongated handle on said bin to aid in wheeling said bin on said at least one wheel.

10. A trash compactor as set forth in claim 9, wherein said latch means includes a substantially horizontal pin fixed on one of said bin and said handle and adapted to enter an aperture on the other of said bin and said handle.

11. A trash compactor as set forth in claim 10, wherein said latch means includes a slidable latch acting between said bin and handle to retain said handle in a given lateral position with said horizontal pin disposed in the cooperating aperture.

12. A trash compactor as set forth in claim 1, wherein said reaction means includes an elongated handle receivable in a generally vertical aperture in said bin, said handle acting on said journal means, and said latch means acting between said handle and said bin to lock said at least one wheel in the downward position.

13. A trash compactor as set forth in claim 12, wherein said bin has a front and said handle is an inverted U-shaped handle receivable in two generally vertical apertures in the front of said bin.

14. A trash compactor as set forth in claim 13, said journal means including an axle for said wheels, and said handle having U-shaped slots on the bottom of each handle end to straddle said axle.

15. A trash compactor comprising, in combination:

a cabinet having upper and lower portions and adapted to rest on a floor;

a wheeled bin receivable inside the lower portion of the cabinet;

a compactor mechanism in the upper portion of said cabinet adapted to compact trash in the bin;

a generally vertical front on said wheeled bin;

means pivoting said bin front to said bin in a location below the top of said bin to establish a top of the front unattached to the top of said bin;

means to mount a bag in said bin to have the trash compacted thereinto;

latch means acting between said vertical front and the remainder of said bin, whereby when said latch means is unlatched the bin front may be pivoted out of the way to permit the compacted bag of trash therein to be removed generally horizontally out of said wheeled bin rather than required to be lifted out of the bin; and said bag mounting means including means to trap a top portion of the bag between the bin front and the remainder of the bin with the bin front latched onto the remainder of the bin.

16. A trash compactor as set forth in claim 15, wherein said bin has a bottom and said bin front is pivoted to said bin bottom to be swung downwardly for access to the compacted trash.

17. A trash compactor as set forth in claim 15, wherein said bin has two generally vertical sides, and said latch means acts between said sides and said front to latch the front in position on the sides for an enclosed bin.

18. A trash compactor as set forth in claim 15, including:

first and second wheels;

said bin having two front corners;

means journaling said first and second wheels, one near each front corner of said bin;

generally vertical lost motion means acting between said journal means and said bin permitting the two wheels to be moved upwardly relative to said bin at least when said bin is in said cabinet and acted on by said compactor mechanism; and reaction means acting between said bin and said journal means to establish the wheels in a downward position whereby the wheeled bin may be withdrawn from the cabinet and be supported on the wheels for rolling engagement with the floor.

* * * * *